US005327714A

United States Patent [19]

Stevens et al.

[11] Patent Number: 5,327,714

[45] Date of Patent: Jul. 12, 1994

[54] SYNTHETIC STRING FOR SPORTING APPLICATION

[75] Inventors: Kenneth A. Stevens, Lansdale, Pa.; David T. Holland, Pennington, N.J.

[73] Assignee: Prince Manufacturing, Inc., Lawrenceville, N.J.

[21] Appl. No.: 921,771

[22] Filed: Jul. 30, 1992

[51] Int. Cl.[5] ..... D02G 3/06; A63B 51/02

[52] U.S. Cl. ..... 57/230; 57/3.5; 57/13; 273/73 R; 273/DIG. 6

[58] Field of Search ..... 57/230; 273/73 R, DIG. 6

[56] References Cited

U.S. PATENT DOCUMENTS

| | | | |
|---|---|---|---|
| 1,279,719 | 9/1918 | Lewis | 273/73 D |
| 1,279,720 | 9/1918 | Lewis | 273/73 D |
| 1,531,835 | 3/1925 | Behr | 273/73 D |
| 1,624,720 | 4/1927 | Dritz | 57/222 |
| 1,669,212 | 5/1928 | Schilz | 57/225 |
| 1,695,596 | 12/1928 | Larned | 428/591 |
| 1,970,376 | 8/1934 | Hamburger | 57/7 |
| 2,055,776 | 9/1936 | Saladino | 57/297 |
| 2,091,999 | 9/1937 | Madge et al. | 87/1 |
| 2,100,250 | 11/1937 | Heyl | 428/389 |
| 2,298,868 | 10/1942 | Catlin | 273/73 D |
| 2,307,470 | 1/1943 | Salathe, Jr. | 428/375 |
| 2,401,291 | 5/1946 | Smith | 57/242 |
| 2,649,833 | 8/1953 | Crandall | 87/1 |
| 2,712,263 | 7/1955 | Crandall | 87/1 |
| 2,735,258 | 2/1956 | Crandall | 57/234 |
| 2,861,417 | 11/1958 | Crandall | 57/7 |
| 3,050,431 | 8/1962 | Crandall | 156/172 |
| 3,164,952 | 1/1965 | Neale et al. | 57/6 |
| 3,738,096 | 6/1973 | Crandall | 57/242 |
| 3,745,756 | 7/1973 | Crandall | 57/234 |
| 3,920,658 | 11/1975 | Benson | 428/395 |
| 3,921,979 | 11/1975 | Dischinger | 273/73 R |
| 3,926,431 | 12/1975 | DeLorean | 273/73 D |
| 4,016,714 | 4/1977 | Crandall et al. | 57/234 |
| 4,043,555 | 8/1977 | Conn | 273/73 D |
| 4,055,941 | 11/1977 | Rivers, Jr. et al. | 57/248 |
| 4,084,399 | 4/1978 | Kanemaru et al. | 57/232 |
| 4,149,722 | 9/1982 | Yager | 273/73 D |
| 4,183,200 | 1/1980 | Bajaj | 57/234 |
| 4,238,262 | 12/1980 | Fishel | 156/166 |
| 4,275,117 | 6/1981 | Crandall | 428/373 |
| 4,297,835 | 11/1981 | Shimizu | 57/231 |
| 4,306,410 | 12/1981 | Nakamura et al. | 57/234 |
| 4,339,499 | 7/1982 | Tappe et al. | 428/373 |
| 4,349,198 | 9/1982 | Stelck | 273/73 D |
| 4,377,288 | 3/1982 | Sulprizio | 273/73 D |
| 4,377,620 | 3/1983 | Alexander | 428/372 |
| 4,391,088 | 7/1983 | Salsky et al. | 57/234 |
| 4,395,458 | 7/1983 | Huang | 428/367 |
| 4,449,353 | 5/1984 | Tayebi | 57/242 |
| 4,462,591 | 7/1984 | Kenworthy | 273/73 D |
| 4,530,206 | 7/1985 | Benichou et al. | 57/250 |
| 4,565,061 | 1/1986 | Durbin | 57/234 |
| 4,568,415 | 2/1986 | Woltron | 156/185 |
| 4,586,708 | 5/1986 | Smith et al. | 273/73 D |
| 4,660,364 | 4/1987 | Chiang | 57/234 |

OTHER PUBLICATIONS

Synthetic Evolution—The Development of Synthetic Racquet Strings, by Dave Holland, U.S.R.S.A. publication, Oct. 1990.

Du Pont Fibers Technical Information—Multifiber Bulletin X-272, Jul. 1988.

Du Pont Technical Bulletin X-272, Jul. 1988 'Properties of Dupont Industrial Filamnet Yarns'.

*Primary Examiner*—Richard L. Raymond
*Assistant Examiner*—Deborah Lamblin
*Attorney, Agent, or Firm*—Pennie & Edmonds

[57] ABSTRACT

A string for sports application, in particular for tennis, badminton, racquetball and squash racquets or the like comprises a center core and at least one ribbon-like wrap made of a highly abrasion resistant material which exhibits a higher melting point and at least one of a higher dynamic stiffness and a lower static stiffness than the core material. A preferred wrap material meeting the above criteria is poly(m-phenylene isophthalamide). The wrap should cover at least 25%, and preferably at least 50% of the center core's outer surface to reduce notching. Due to the reduced notching, superior combined properties of durability, playability and minimal loss of string tension are achieved.

53 Claims, 13 Drawing Sheets

SYNTHETIC STRING FOR SPORTING APPLICATION

BACKGROUND OF THE INVENTION

1. Field of the Invention

This invention relates to a synthetic string for sporting applications such as tennis, badminton, racquetball and squash racquets or the like.

2. Description of the Prior Art

Racquet strings generally come in a variety of nominal diameter sizes (gauge) and are tensioned between 10 to 85 pounds, the string gauge and the tension depending upon the size of the racquet, the style of play and preference of the player. Conventional racquets are basically strung with either two-piece strings or one piece string, the latter being preferable since only two knots rather than four knots are required to tie the ends of the string. Conventional racquet strings have two string components, main-strings running generally parallel to the length-wise direction of the racquet and cross-strings running perpendicularly to the main-strings. In stringing a conventional stringing pattern, usually all of the main strings are positioned and tensioned first and then each cross-string is woven through the main string and tensioned. The cross-strings in general are interwoven alternately with the main-strings to form an interwoven mesh-like pattern.

The performance of a string is categorized in several ways. The three most important performance categories are playability, durability and tension loss. In prior strings, there was always a tradeoff between a highly playable string which sacrificed durability and a highly durable string which sacrificed playability. One example of a highly playable string which sacrifices durability is a natural gut string from sheep, cow, whale, and others. A natural gut string plays well because it is highly elastic (low in static stiffness) and highly resilient (low in dynamic stiffness). Elasticity is defined as the ability of a material to return to its original dimensions after the removal of stresses. Resilience is defined as the potential energy stored up in a deformed body. A natural gut string, however, is very sensitive to humidity, causing the string to either break or lose tension sooner and is highly susceptible to fraying (peeling) from abrasion, particularly at the string crossover locations, wearing the string rapidly.

An example of a highly durable string, but with less than average playability is a synthetic string which incorporates a highly abrasion resistant fiber such as para-aramids (KEVLAR, TECHNORA, TWARON), melt spun liquid crystal polymers (VECTRAN) and high molecular weight polyethylene (SPECTRA). These materials are highly abrasion resistant. However, they are also extremely stiff and inelastic, undesirably increasing the overall dynamic and static stiffnesses of the string, which contributes to a board-like feel which diminishes playability.

There are three modes of wear on a string. In the first mode, the rubbing action of the main-string over and against short lengths of the cross-strings creates notches in the main-strings. During play, particularly in tennis, the ball is usually hit with some degree of spin, the degree of spin depending on the particular shot being made, the style of the player and the string gauge, texture and spacing. Normally, to generate a spin on the ball, the string is brushed, in the direction parallel to the cross-strings and thus perpendicular to the main-strings, against the fuzzy, rough surface of the ball which imparts a tangential force on the ball and causes the main strings to slide over and rub against the cross strings. Rough textured strings generally impart more spin to the ball since the higher surface friction tends to bite into the ball better. Generally the greater the spin imparted to the ball, the greater the force will be placed on the main-strings, in the perpendicular direction thereof, forcing the main-strings to rub against the cross-strings. Specifically, since the ball is brushed parallel to the cross-strings, the cross-strings remain substantially stationary while the main-strings slide across the cross-strings. Thus, the cross-strings can be envisioned as a stationary knife or saw-like instrument cutting through the main-strings each time the main-strings move across the cross-strings.

All main-strings begin to experience notching to some degree in the outer coating and/or wraps thereof as one string rubs against another. The notching initially cuts through the outer coating or outer wraps and into the center core until the string prematurely breaks. See FIGS. 5, 5*a*. The primary reason for string breakage is due to the notch cutting into the core.

The second mode of wear occurs from the actual rubbing friction the ball creates during contact directly with the string surface. This is most pronounced on the top portion of the string where the intersections of the main- and cross-strings are created in a woven string mesh. See FIGS. 5, 5*b*.

The third mode of wear occurs on the stationary cross-string as the main-string slides across it. The rubbing friction of the notched area of the main-string over the length of the rubbing contact thereof with the cross-strings causes the cross-string to be gradually worn down. See FIGS. 5, 5*c*.

Wide-body racquets are the latest trend in the tennis world. With the advent of wide-bodies, a stronger and more durable string, able to withstand extreme string abrasion is needed. Wide-body racquets are extremely rigid and thus bend very little on impact, forcing the string-bed to work harder. The string has to work harder since there is no give or deflection in the racquet to absorb the energy imparted by the ball. Therefore, more energy is transferred to the string, causing greater loads on the strings and string intersections. As a result, string notching and premature string failure occurs more rapidly with wide-bodies. There is a great need, with the advent of wide-bodies, for a more durable string that is also playable.

Attempts have been made in the past to alleviate the notching problem. For example, U.S. Pat. No. 3,921,979 contemplates placing a small, self-lubricating plastic cross guide between each intersection of the main-strings and the cross-strings. However, the guides of the type contemplated in U.S. Pat. No. 3,921,979 are inconvenient and do not work well because they fall off the string with use, due to the impact. Moreover, the extraneous mass of the guides can also cause undesired vibrations. For these reasons, the guides of the type described in U.S. Pat. No. 3,921,979 have not been successful.

U.S. Pat. No. 4,238,262 issued to Fishel contemplates coating the intersection of the cross-strings and the main-strings with elastic adhesive to form a bond therebetween to prevent the strings from moving relative to each other. Although bonding strings together will alleviate the notching problem in the main-strings, the disadvantage to this is that if the strings are effectively bonded, their playability will be substantially degraded due to the adhesive interacting with the strings. Strings that are bonded at their intersection tend to feel "board-like" because the bonding at the intersection has the effect of stiffening the string-bed.

U.S. Pat. No. 4,377,620 discloses synthetic or natural gut strings which are coated with a coating film of minute particles of ethylene tetrafluoride. The particles are of a size ranging from 0.1 to 10 microns and are applied either from a dispersion in a solvent which is allowed to dry, or from a molten vehicle which is allowed to harden. The final string has only discontinuously spaced particles of the ethylene tetrafluoride in a thickness of the order of approximately 20 microns. As a result, the particles wear away quickly and thereafter the problem of notching and tension loss can ensue. Thus, the coating film of minute particles taught by this patent gives only temporary and limited protection against string wear.

Many types of racquet string construction have been contemplated in the past in attempting to produce strings that are durable and have a good playability. Some incorporate a durable abrasion resistant material of aramid polymer generically known as KEVLAR which is poly (paraphenylene terephthalamide), to form a durable, notch resistant string. KEVLAR material has excellent abrasion resistance. However, because KEVLAR material is relatively inelastic and has a very low resiliency, strings incorporating this material generally play very "board-like" and thus lack playability. In another instance, U.S. Pat. No. 4,530,206 shows a tennis racquet string incorporating twisted KEVLAR material in combination with a glass fiber as a core of the string, the elasticity of the string being not more than 5% at its maximum loading capacity.

In other types of string sold under the names of Endurance by Prince Manufacturing Inc. and Twaron by Head Sports, Inc., a nylon core is wrapped with a ribbon-like helical wrap of para-aramid fibers, the Prince string having a KEVLAR wrap and the Head Sports string having a TWARON wrap which is a KEVLAR type aramid fiber. The purpose of the wrap is to shield the core with an abrasion resistant material. Again, while KEVLAR/TWARON material has excellent wear characteristics, it is generally not a preferred material for a racquet string because the relatively inelastic characteristic of KEVLAR/TWARON material constrains the nylon core from stretching, causing the overall string to be less elastic and resilient (higher static and dynamic stiffness).

U.S. Pat. No. 4,391,088 contemplates a composite gut string which incorporates a highly resilient (low dynamic stiffness) gut center core reinforced with a protective jacket of highly inelastic (high static stiffness) KEVLAR material. The gut core is shielded with braided KEVLAR fibers. The reinforced core is then coated with polyurethane resin to seal the string. In essence, this string has a very low dynamic stiffness core encased in a very high dynamic stiffness KEVLAR sheath. Under tension, the sheath of the string would predominate as the load bearing element over the center core being loaded. Although durability will increase, the playability will suffer greatly due to the fact that the inelastic and nonresilient characteristics of the KEVLAR sheath would dominate.

Wilson Sporting Goods Company has marketed a tennis string called DUALTEC 137 which is similar to the performance of the string set forth in U.S. Pat. No. 4,391,088, in that a relatively low dynamic stiffness core is wrapped or surrounded by a very high dynamic stiffness aramid fiber known as TECHNORA, which is co-poly-(paraphenylene/3,4'-oxydiphenylene terephthalamide). Specifically, a pair of ribbon-like wraps of TECHNORA is spirally wrapped around a nylon core in opposite directions at 180° apart. Due to the fact that TECHNORA material has a very high dynamic stiffness and is very inelastic, much like KEVLAR, it is generally not a preferable material for constructing a racquet string.

U.S. Pat. No. 4,568,415 shows a method of manufacturing a string which features a pair of ribbon-like wraps that are helically wound around a continuous core, similar to the wraps of DUALTEC 137. The disclosure relating to the manner in which the ribbon-like wraps are helically wound around the center core is incorporated herein by reference. The helically wound wraps of this patent are made of plastic, preferably olefins of high molecular weight and polyethylene/-polypropylene/diene terpolymers of high molecular weight. The wraps made from these materials are relatively elastic in comparison to the KEVLAR material, but they are not as abrasion resistant and thus have little capability of preventing or retarding the notching from cutting into the core.

U.S. Pat. No. 4,275,117 discloses a string resulting from the integration of a thermoplastic sheath with a thermoplastic braided core of a different melting point under heat. By using a high melting sheath and a low melting core, the core can be melted into the sheath. Conversely, by using a low melting sheath and a high melting core, the sheath can be melted into the core. Additionally, a relatively high melting spiral wrap can be applied around the integrated core and sheath. Under heat, the spiral wrap is integrated into the sheath-/core. Nylon 66 having a melting point of approximately 480° F. is given as an example of the higher melting point thermoplastic material. A nylon terpolymer having a melting point of approximately 310° F. and nylon 12 having a melting point of approximately 350° F. are given as examples of the lower melting point thermoplastic material. The wraps made of the material set forth in this patent are made of relatively low melting point materials which have limited capacity to withstand the instantaneous frictional heat and temperature increase induced therein during ball impact on the strings. Thus, these relatively low melting point materials have limited effectiveness in preventing or retarding notching from cutting into the core.

U.S. Pat. No. 4,016,714 discloses a string formed by twisting a plurality of single strands to form a core and then forming an outer thermoplastic shell. In addition, to strengthen the string, a pair of spiral wraps of nylon monofilament is helically wound around the shell. The patent discloses that the core may be made of a variety of materials, such as nylon, polyester, fiberglass, and aramid fibers such as KEVLAR and NOMEX. However, without a protective wrap of abrasion resistant material around the core, in accordance with the present invention, notching of the conventional outer wraps disclosed in this patent can readily occur, and thereafter a NOMEX core alone (low in tensile strength) is not capable of bearing the load, resulting in string failure.

While the present invention can be understood and readily practiced by those skilled in the art without an understanding of the underlying theories of racquet strings, U.S. Pat. No. 4,183,200 to Bajaj, U.S. Pat. No. 4,565,061 to Durbin and U.S. Pat. No. 4,586,708 to Smith, et al. are cited herein as disclosing certain theories of what makes a good playable string, the disclosures of which are incorporated herein by reference. Bajaj has theorized that a constant spring rate (which measures the static stiffness or the elastic modulus) is the main contributing factor of a string's playability. Durbin has theorized that a good playable synthetic string should have a tensile stress greater than 20,000 psi and an elastic modulus less than twice the tensile stress, in contrast to what has been thought to be desirable as the opposite. A natural gut, for instance, has a tensile stress/elastic modulus ratio of 0.13, whereas the commercially available synthetic showed the ratio to be around 0.30. Basically according to Durbin's teachings, a string with a relatively lower elastic modulus or static stiffness, as disclosed in Bajaj, is preferred. Smith, et al. have theorized that for a racquet string to have good playing characteristics, it must possess several important properties, namely resilience (coefficient of restitution which measures the amount of energy which is returned to the ball by the string on impact) and elasticity (which measures the dynamic stiffness).

Smith, et al.'s string is composed of polyetheretherketone, also known as PEEK. Prince Manufacturing, Inc. utilizes this technology to produce PREMIERE strings which consisted of 100% PEEK coated with nylon. The PEEK string exhibited some increase in durability and notch resistance over conventional nylon strings. However, the string made of PEEK could not provide the superior combined properties of playability, durability and resistance to notching achieved by the string of the present invention. Prince Manufacturing Inc. also marketed a subsequent string called RESPONSE which was a combination of PEEK with nylon multifilaments. This string gave a small improvement in durability but at the sacrifice of playability and thus provided only a modest improvement in combined properties of playability, durability and resistance to notching.

SUMMARY OF THE INVENTION

The principal objective of the present invention is to provide a synthetic string for sporting applications, which has superior combined properties of high durability, resistance to notching and excellent playability, in particular, to achieve as much as possible the combined playing characteristics of gut, i.e., its dynamic stiffness (resiliency) and static stiffness (elasticity) with the durability of 100% KEVLAR string, when strung at both low and high tensions. By achieving such superior combined properties, undesirable effects such as tension loss are minimized.

It has been found that the above objective can be achieved, by wrapping or jacketing a conventional core of a synthetic material, such as nylon or PEEK, either partially or fully, with at least one, preferably two, ribbon-like wraps made of a highly abrasion resistant material which exhibits a higher melting point and at least one of a higher dynamic stiffness (lower resiliency) and a lower static stiffness (higher elasticity) than the core material, measuring the stiffnesses of the respective materials at 60 pounds of tension. The wrap is preferably made of NOMEX fiber, which is poly(m-phenylene isophthalamide) made by reacting meta-phenylene diamine with isophthaloyl chloride, or a like material which exhibits similar physical properties. Like KEVLAR, NOMEX is highly abrasion resistant and has a relatively high melting point, around 700° F. (371° C.), but unlike KEVLAR, NOMEX is resilient and elastic, and has been found to be highly suitable for incorporation in racquet strings, particularly as a wrap around a string core. The present inventors have discovered that when utilized as a wrap in a racquet string in the manner described above, a high melting point material such as NOMEX or the like, increases the string's durability substantially by resisting notching more effectively.

It is to be noted that the present invention is not to be limited to the use of NOMEX as a wrap material, but properly includes all other materials exhibiting substantially equivalent physical properties, namely, the characteristics of abrasion resistance, elasticity, resiliency, and melting point, in relation to the core material, as discussed above.

Moreover, while fully jacketing the core with a wrap of material such as NOMEX effectively prevents the notching from cutting into the core at all points of the string, it is not necessary to cover 100% of the core to prevent such notching since the actual notching areas (intersection of main- and cross-strings) are relatively small in relation to the overall surface area of the string. In other words, the core needs to be protected primarily in the areas where the strings rub against one another. Accordingly, a single ribbon-like wrap of NOMEX that covers at least 25% of the surface of the core by helically wrapping the core, can effectively prevent the notching from cutting into the core. However, it is preferable to incorporate two, 180° spaced apart, ribbon-like wraps of NOMEX helically wrapped in the same direction, covering at least 50% of the outer surface of the core to evenly balance the string construction. Other methods of wrapping the core, such as braiding, cross bias wrapping with oppositely biased plys, can be used to form the NOMEX wraps in accordance with this invention, but are usually more expensive and therefore not preferred. The wrapped core is covered by an outer protective sheath which, in turn, is sealed by an outer coating to give a smooth outer texture for ease of stringing and to more fully protect the core.

The present invention contemplates use of any conventional core which exhibits resiliency and elasticity, such as nylon or nylon copolymer, whether monofilament or multifilament, and cores made of other materials such as polyester, polybutylene terephthalate, polypropylene-polyethylene-diene terpolymer, polyphenylene sulfide and polyetheretherketone. However, it is within the purview of the present invention to use a core consisting of NOMEX material or the like, in whole or in part, since NOMEX material is relatively resilient and elastic. In the embodiment that incorporates NOMEX as the center core, the melting point, the static and dynamic stiffness (elasticity and resiliency) thereof are substantially similar to the protective wrap(s) since the core is made of the same or the like material.

In the present invention, while the notching effect can cut through the outer coating and sheath, the notching is prevented or minimized once it reaches the NOMEX wrap(s). Due to the abrasion resistance of the NOMEX wrap(s), the durability, i.e. the life of the string is significantly increased, up to 50% or more, by protecting the important center core. Also due to its elasticity and resiliency, unlike KEVLAR, TECHNORA and TWARON wraps, NOMEX wraps do not increase the overall dynamic and static stiffnesses of the string, i.e., do not sacrifice playability.

DESCRIPTION OF THE PREFERRED EMBODIMENT

Figure 1:
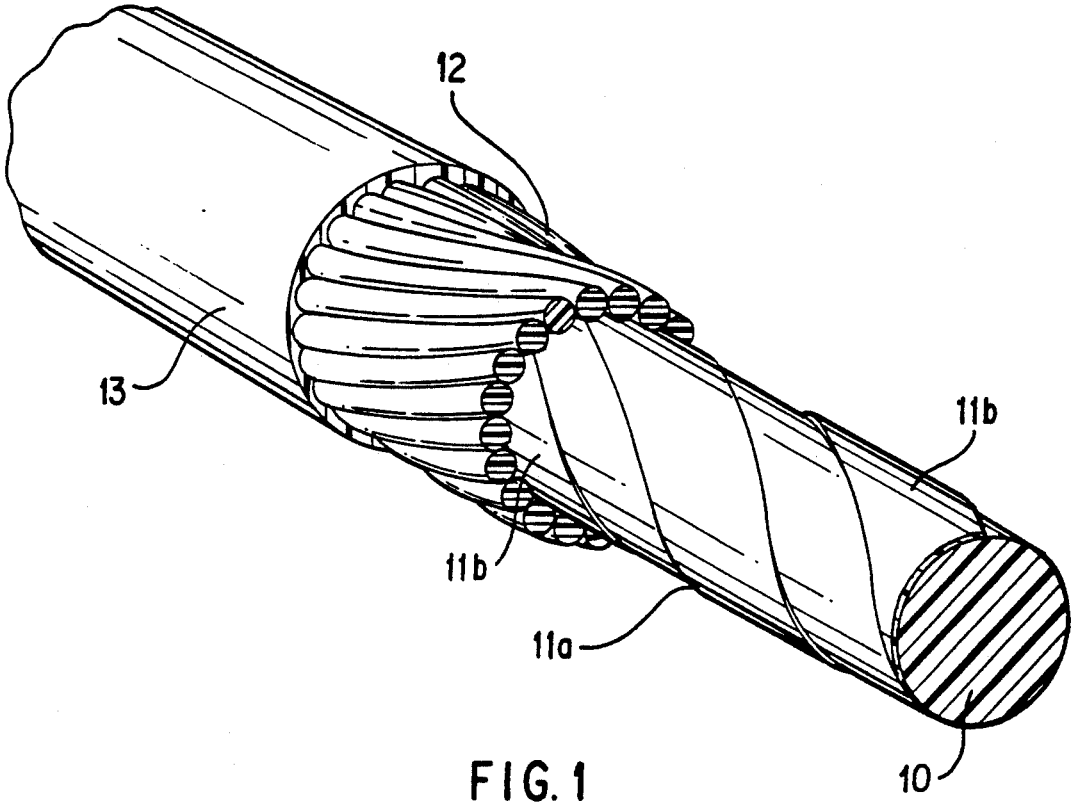
FIG. 1 is a perspective view partly in section of a preferred embodiment of a string made in accordance with the teachings of the present invention.

The present invention, as shown in the drawings, is described in terms of four different embodiments. Same or equivalent elements of the embodiments illustrated in the drawings have been identified with same reference numerals.

The following description of the drawings are merely for the purpose of illustrating the principles of the present invention and, accordingly, the present invention is not to be limited solely to the exact configuration and construction and the examples as illustrated and set forth herein. All expedient modifications readily known or obvious to one skilled in the art from the teachings of the present invention, which may be made within the scope and essence of the present invention, are included as further embodiments thereof.

FIG. 1 shows a fragmentary side elevation view of the preferred embodiment of the present invention, which shows a center core (10) helically wrapped by two ribbon-like wraps (11*a*, 11*b*), generally spaced 180° apart around the perimeter of the core and wound in the same direction to cover at least 50% of the outer surface of the core. The method by which the wraps can be helically wound are disclosed, for example, in U.S. Pat. No. 4,568,415 which is incorporated herein by reference, as previously indicated, except that the NOMEX wraps used in the strings of this invention are helically wound in the same direction in contrast to the counter wraps disclosed in the patent as wound in opposite directions.

Additionally, the protective wraps and the core are fully jacketed using a conventional string outer sheath (12), for example, as set forth in U.S. Pat. Nos. 4,183,200 issued to Bajaj; 3,164,952 to Neale, et al.; and 3,050,431 to Crandall, which are incorporated herein by reference. Basically the sheath comprises a plurality of relatively small diameter strands completely wrapped or twisted around the core at a preset angle in a well known, conventional manner. The outer surface of the string is then coated with an adhesive layer (13) to seal the string against moisture and environment in the well known, conventional manner as described, for example, in Bajaj.

Figure 1A:
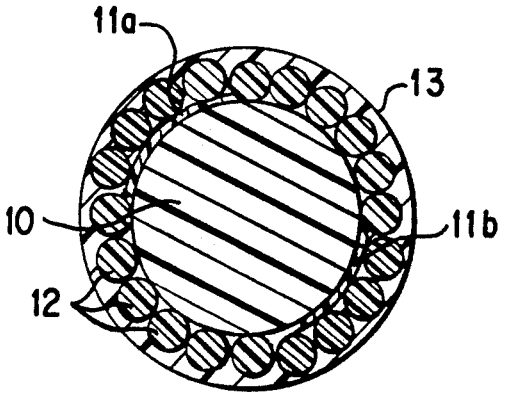
FIG. 1*a* is a cross-sectional view of the string shown in FIG. 1.

FIG. 1*a* shows the cross-sectional view of FIG. 1, which clearly shows the two ribbon-like wraps (11*a*, 11*b*) being spaced generally 180° apart and thus being spaced diametrically opposite each other around the core (10). The larger circles (12) depict the outer wrap strands comprising the sheath, and the outer coating or sealing layer is designated by 13.

Figure 2:
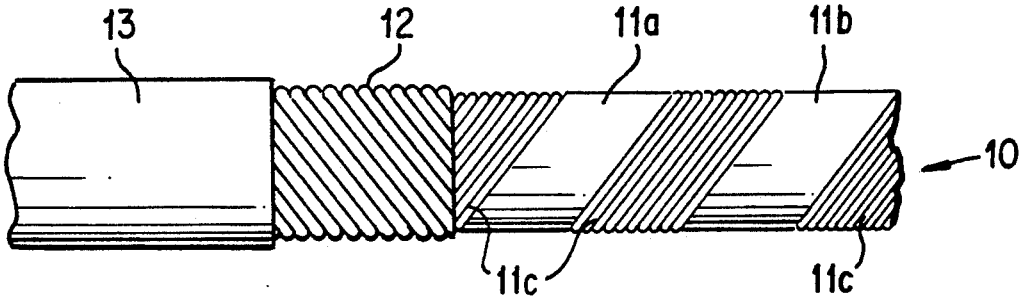
FIG. 2 is a fragmentary side elevation view of an alternative embodiment of a string made in accordance with the teachings of the present invention.
Figure 2A:
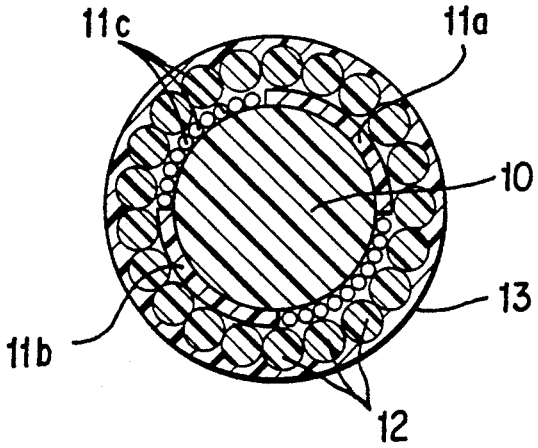
FIG. 2*a* is a cross sectional view of the string shown in FIG. 2.

FIG. 2 shows a fragmentary side elevation view of an alternative string that is similar to the string illustrated in FIGS. 1 and 1*a*. In the FIG. 2 embodiment, the exposed surface of the center core (10) not covered by the double helical NOMEX wraps (11*b*) in FIG. 1 is covered by additional multifilament yarns (11*c*), preferably of nylon 6, wrapped in the same helical direction as, and occupying the intervening spaces between, the parallel double NOMEX wraps. As shown in the FIG. 2*a* cross section, this results in a more balanced construction in which the NOMEX and nylon 6 helical wraps provide a more even layer of wrapped material around the core, as compared to FIG. 1 where the alternating intervening spaces between the double helical wraps around the center core are not similarly occupied.

Figure 3:
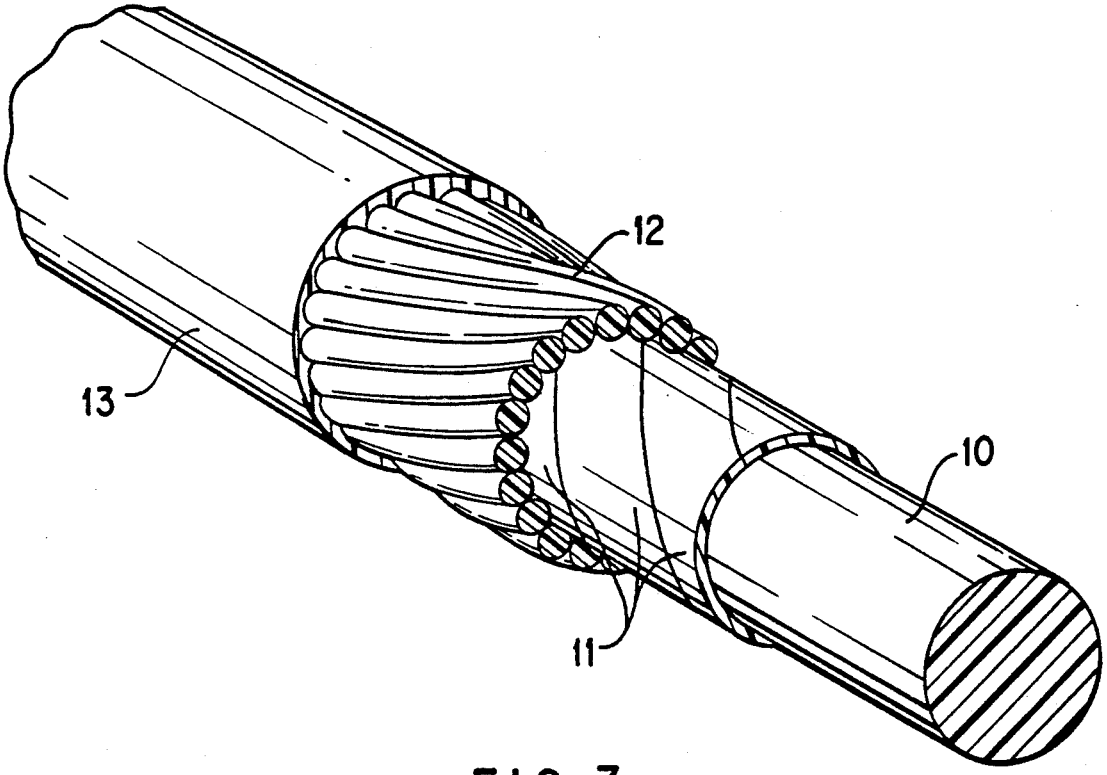
FIG. 3 is a perspective view partly in section of another alternative embodiment of a string made in accordance with the teachings of the present invention.

FIG. 3 shows another embodiment of the present invention, wherein the only difference between it and the FIG. 1 embodiment is that the protective wrap (12) in FIG. 3 fully covers the core (10), leaving no exposed core surface. Here a plurality of NOMEX wraps (11) are abutted to each other, without intervening space between them, and helically wrapped around the core in the same direction to completely cover the core.

Figure 3A:
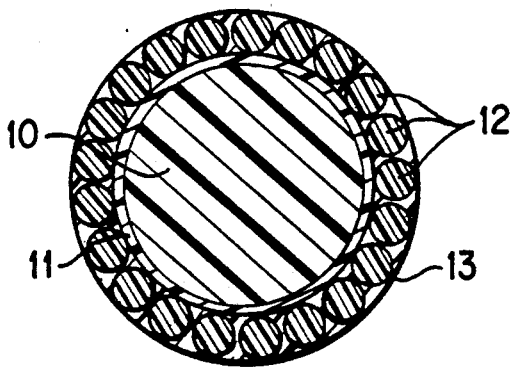
FIG. 3*a* is a cross-sectional view of the string shown in FIG. 3.

FIG. 3*a* shows the cross-sectional view of FIG. 3, which clearly illustrates the relationship of the core (10), the protective wraps (11), the outer sheath (12) and the sealing layer (13) of the string in the embodiment of FIG. 3.

Figure 4:
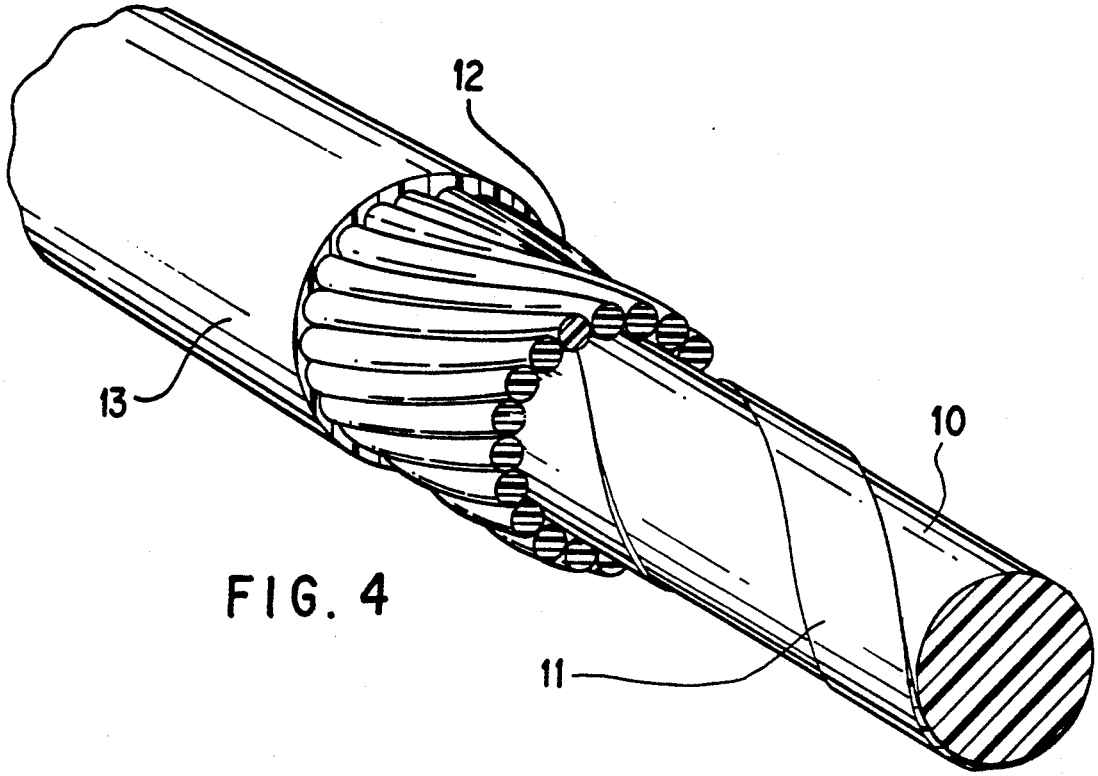
FIG. 4 is a perspective view partly in section of a further alternative embodiment of a string made in accordance with the teachings of the present invention.

FIG. 4 shows yet another embodiment of the present invention, wherein the only difference between it and the embodiments of FIGS. 1 and 3 is that the protective wrap of FIG. 4 consists of a single ribbon-like wrap (11) helically wrapped around the center core (10), covering up to 25% of the string to effectively prevent the notching from cutting through the center core.

Figure 4A:
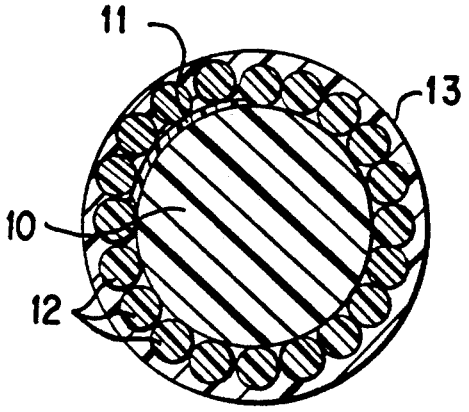
FIG. 4*a* is a cross-sectional view of the string shown in FIG. 4.

FIG. 4a shows the cross-sectional view of FIG. 4, which clearly illustrates the relationship of the core (10), the protective wrap (11), the outer sheath (12) and the sealing layer (13) of the string in the embodiment of FIG. 4.

For the purposes of carrying out the teachings of the present invention, the center core (10) can be any center core such as extruded nylon or nylon copolymer, polyester, polybutylene terephthalate (PBT), polypropylene-polyethylene-diene terpolymer (PPT), polyphenylene sulfide (PPS) or polyetheretherketone (PEEK), whether the core is monofilament or multifilament. In the embodiment of the invention which uses NOMEX material as the core, it is to be noted that although NOMEX exhibits excellent static and dynamic stiffness, it is relatively weak. The tensile strength of NOMEX is about half that of a regular nylon 6, which is a conventional material for making the core of the string. Therefore, to make the string entirely out of NOMEX is not desirable for strings that are strung at high tensions. However, such a string is feasible for racquets that require a low tension such as squash and badminton.

Figure 5:
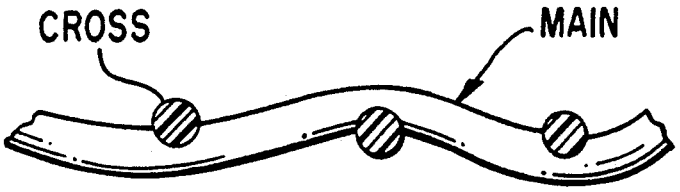
FIG. 5 is a cross-sectional view of the cross-strings in relation to a main-string.
Figure 5A:
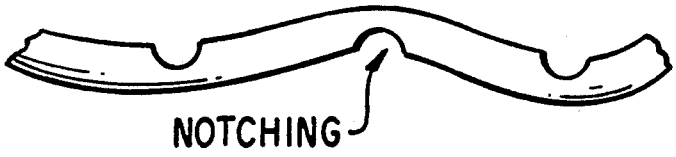
FIG. 5*a* shows the main string of FIG. 5, with the cross-strings removed to illustrated notching.

FIG. 5 shows the relationship between the main string and cross strings. During play, the ball is brushed against the main strings at an angle, imparting a movement of the main-string in the direction parallel to the cross-strings. After a period of use, the notching occurs, eventually eating right through the main-strings. FIG. 5a shows a main string with the cross-strings removed, illustrating the result of notching in the main-string.

Figure 5B:
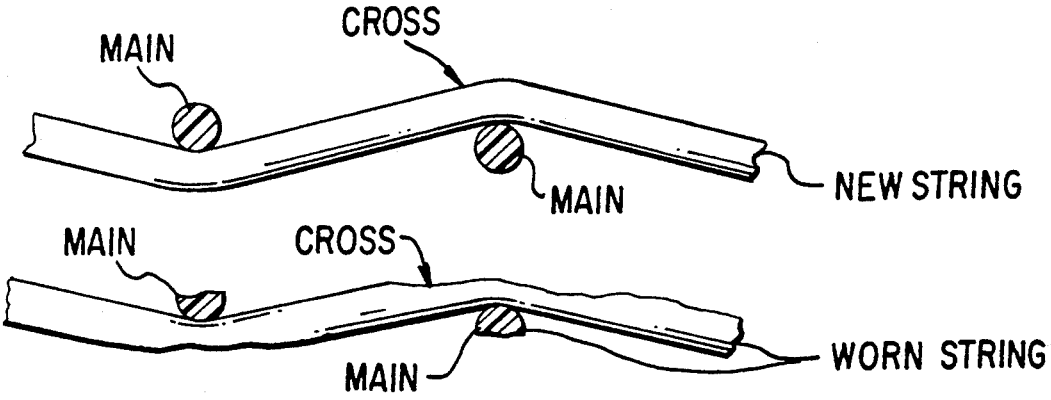
FIG. 5*b* shows an intersection between a main-string and a cross-string when new and after wear due to ball impact.

FIG. 5b shows the wear that occurs on the tops of cross-strings and main-strings as a result of ball impact on these surfaces. Without the protection of the helical abrasion resistant wraps provided in accordance with this invention, such wear can progress through the outer coating and sheath and into the center core, leading to premature string breakage.

Figure 5C:
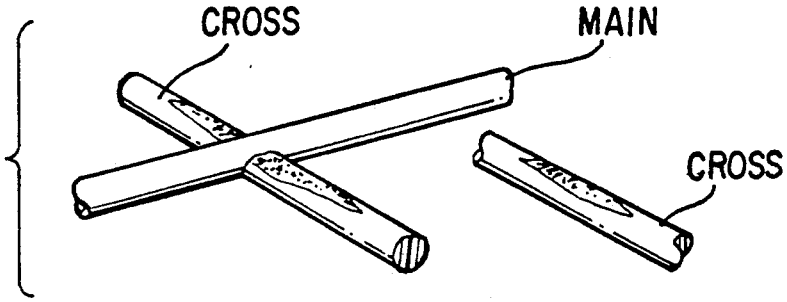
FIG. 5*c* shows the wear on the stationary cross-string due to the notched area of the main-string rubbing across it.

FIG. 5c shows the wear that takes place on the cross-strings as a result of the main-strings rubbing across the cross-strings when spin is imparted to the ball. Again, such wear can contribute to early string failure absent the protective helical wraps of abrasion resistant material provided in accordance with this invention.

The characteristics of the string according to the teachings of the present invention and its advantages may be exemplified by the following example. The scope and essence of the present invention should not be taken to be limited to the examples set forth below.

EXAMPLE OF THE PREFERRED EMBODIMENT

With reference to FIGS. 1 and la, a monofilament center core (10) of a copolymer of 85% nylon 6 and 15% nylon 66 by weight is extruded, prestretched, thermoset and then resin coated. Two ribbon-like wraps (11a, 11b) of NOMEX material, spaced generally 180° apart around the perimeter of the core, each wrap approximately 0.7 mm wide and 0.05 mm thick, are helically wrapped in the same direction and bonded to cover 50% of the core surface. An outer wrap (12) of multifilament nylon 66 is then helically wrapped at a predetermined angle in the opposite direction relative to the NOMEX wraps (11a,11b) and the core (10) to form a sheath. Finally, an outer coating (13) of nylon 66 is thermocoated to seal the string from the environment to produce a finished 16 gauge string.

NOMEX is an aramid fiber of poly(m-phenylene isophthalamide) formed by reacting meta-phenylenediamine with isophthaloyl chloride. KEVLAR and TECHNORA are also an aramid fiber, but are variations of poly(p-phenylene isophthalamide) formed by reacting para-phenylenediamine with terephthalic acid, with TECHNORA having the previously specified copolymer composition. Basically, the fundamental difference between the molecular structure of NOMEX and KEVLAR/TECHNORA is that NOMEX has 1,3 meta-linkage whereas KEVLAR/TECHNORA has 1,4 para-linkage. Even though they are all of the aramid family, their physical properties are quite different in many respects. The key advantage of NOMEX is that it is very flexible and elastic even though it is highly abrasion resistant. Due to the fact that NOMEX is very elastic, it will stretch to accommodate the tension increase under dynamic impact of the ball. KEVLAR, TECHNORA and TWARON, and other abrasion resistant materials such as VECTRAN and SPECTRA, are extremely stiff which increases the overall dynamic and static stiffnesses of a string, sacrificing its playability.

1. Stress-Strain Properties

Figure 6A:
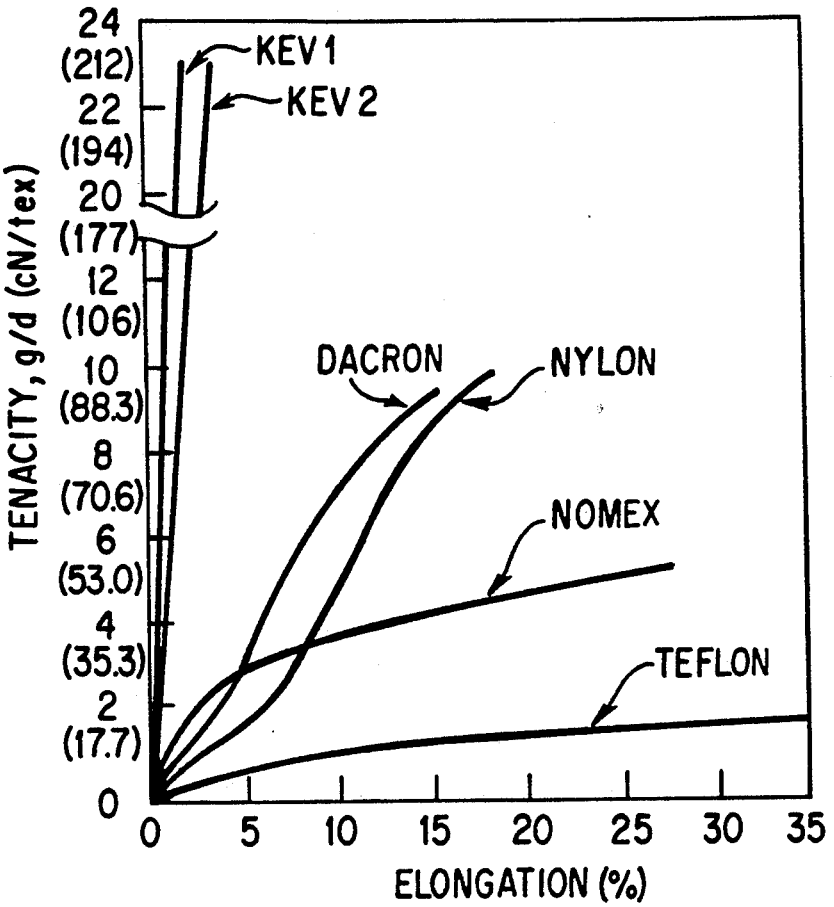
FIGS. 6 and 6 a show stress-strain curves for various materials, including NOMEX, TECHNORA and KEVLAR. PPTA designates a para-aramid fiber having the chemical structure of KEVLAR and TECHNORA.
Figure 6:
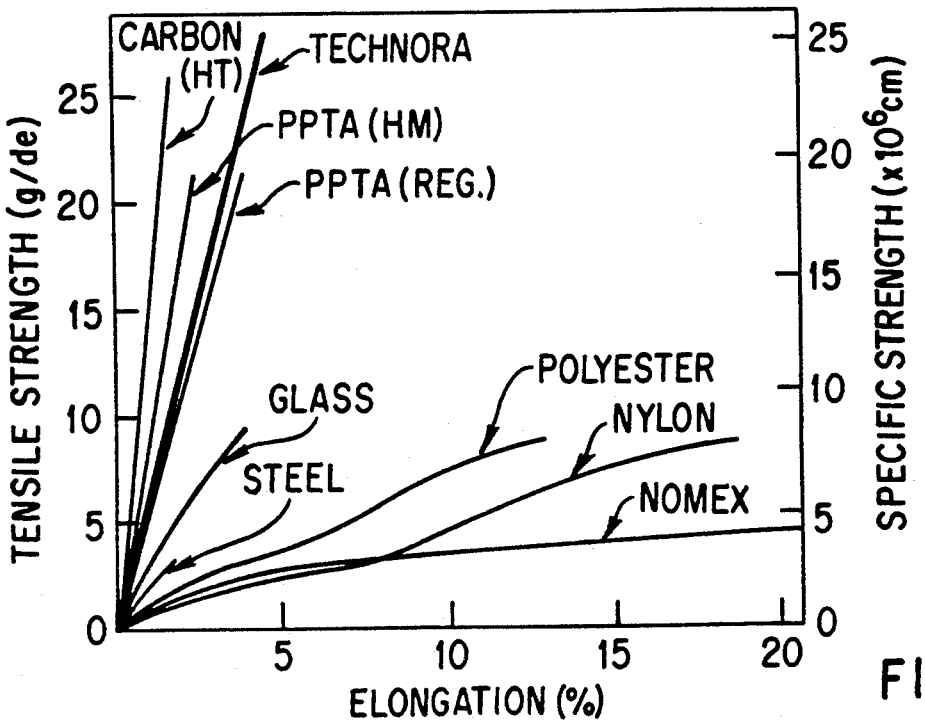

FIGS. 6 and 6a show stress-strain curves for various synthetic materials. FIG. 6 is a replication of Graph 1 Stress-strain curves set forth in Technical Information Bulletin, TIE-05-89.11, Teijin Ltd., with the exception of the curve for NOMEX, which has been interpolated using information in FIG. 6a herein for purposes of comparing NOMEX with TECHNORA. FIG. 6a is replication of FIG. 1 set forth in DuPont Fibers, Technical Information Bulletin X-272, July 1988. As clearly shown in the stress-strain curves, KEVLAR, PPTA and TECHNORA para-aramid type materials exhibit extremely steep slopes in comparison to that of NOMEX and nylon. They are highly inelastic, even less elastic than metal or glass. Table 1 below sets forth certain stress-strain properties and melting point of various types of KEVLAR and TECHNORA in comparison to NOMEX. Information from Table 1 is from Table II set forth in DuPont Fibers, Technical Information Bulletin X-272, July 1988. Information on TECHNORA is from the above-cited Teijin Ltd. bulletin.

TABLE 1

STRESS-STRAIN & MELTING POINT PROPERTIES

| | NOMEX | TECHNORA | KEVLAR 29 | KEVLAR 49 |
|---|---|---|---|---|
| Breaking Strength (lbs) | 13.0 | — | 76.0 | 59.3 |
| Breaking Tenacity (g/d) | 4.9 | 28 | 23.0 | 23.6 |
| Elongation @ 5 lb (g/d) | 1.8 | — | — | — |
| @ 10 lb | 11.0 | — | — | — |
| @ break | 28.0 | — | 3.6 | 2.4 |
| Initial Modulus (Static Stiffness | 95.0 | 590 | 555 | 885 |

TABLE 1-continued

| STRESS-STRAIN & MELTING POINT PROPERTIES | | | | |
|---|---|---|---|---|
| | NOMEX | TECHNORA | KEVLAR 29 | KEVLAR 49 |
| Index) (g/d) | | | | |
| Melting Point (°F.) | 700 | — | 800 | 800 |

Table 1 shows that the initial modulus or elastic modulus, which measures the static stiffness of the material, for NOMEX is substantially less than that of KEVLAR and TECHNORA, as much as nine times lower. The initial modulus, i.e., static stiffness, was determined pursuant to the method prescribed in ASTM D2256. According to the teachings of U.S. Pat. Nos. 4,565,061 and 4,813,200, which are incorporated herein as reference, as previously indicated, it is desirable to produce a string with a relatively lower elastic modulus (initial modulus). On the other hand, KEVLAR and TECHNORA materials have a very high elastic modulus, making these materials undesirable for highly playable racquet strings. TECHNORA exhibits substantially similar physical properties as KEVLAR. While the strings are not totally made of these materials, nevertheless, as KEVLAR and TECHNORA exhibit almost no elongation and very small at the breaking point, the physical attributes of KEVLAR and TECHNORA will dominate, stiffening (increasing the static stiffness) the string and decreasing its performance.

2. Dynamic Stiffness

Figure 7:
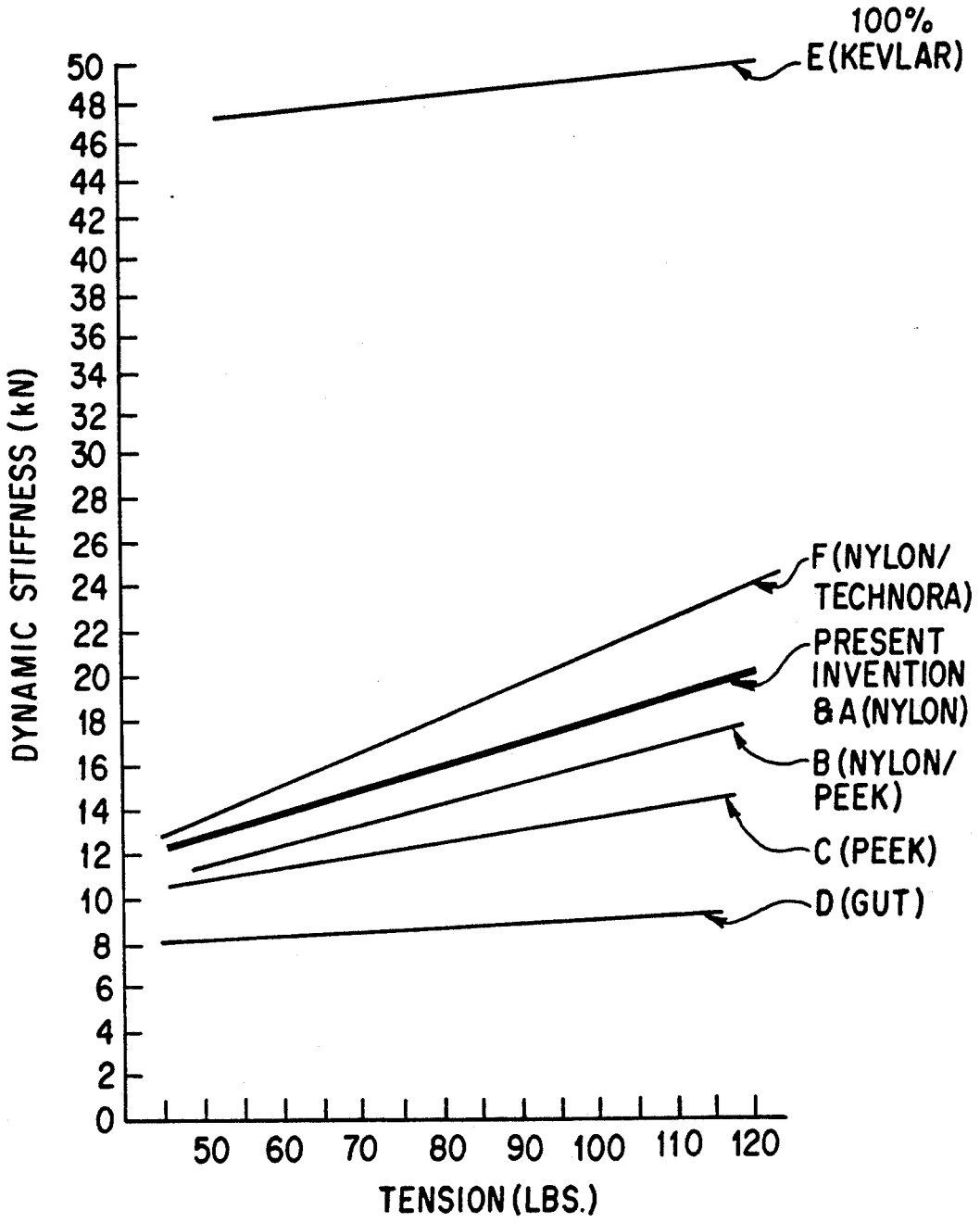
FIG. 7 shows dynamic stiffness curves of strings made of different materials, including NOMEX, TECHNORA and KEVLAR.
Figure 7A:
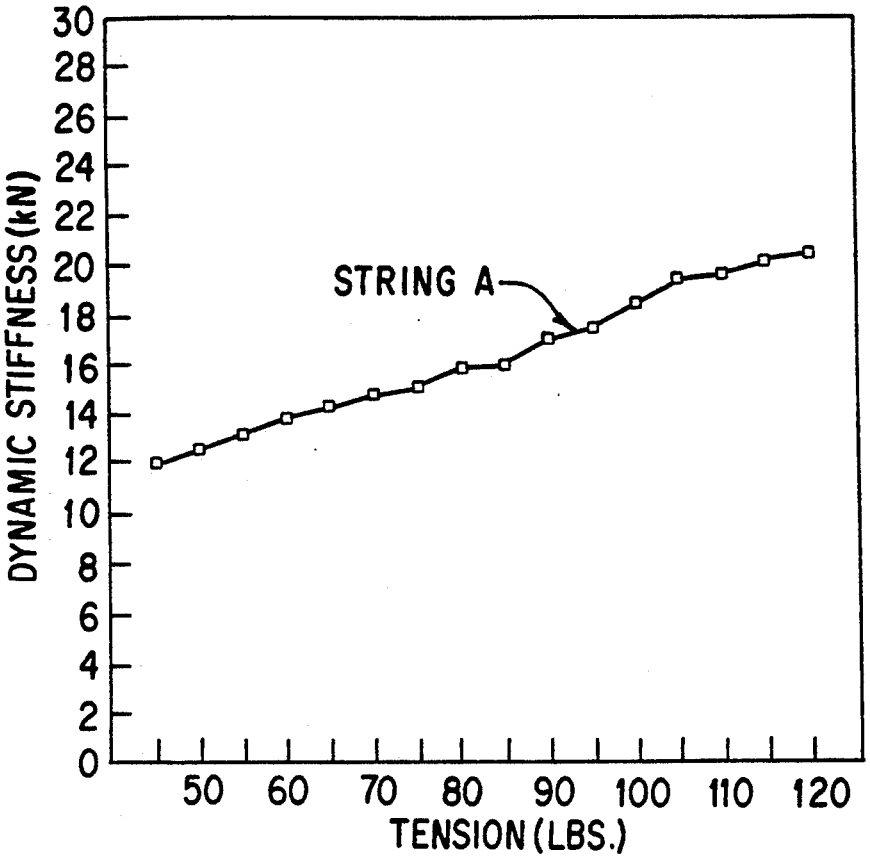
FIG. 7*a* shows the dynamic stiffness curve separately for the A string shown in FIG. 7.
Figure 7B:
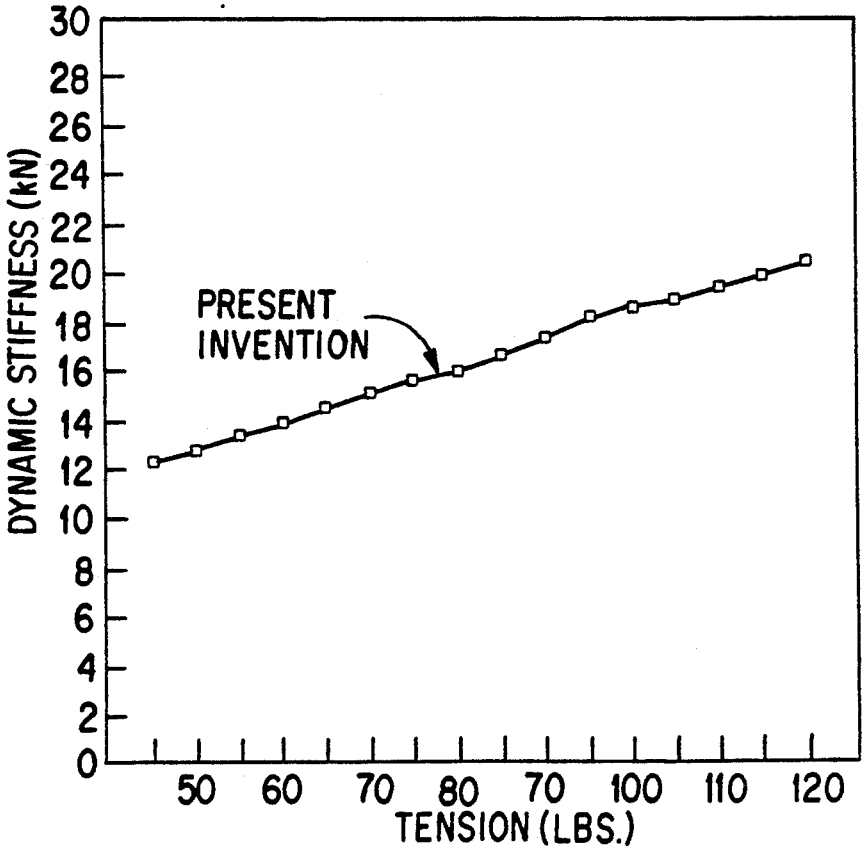
FIG. 7*b* shows the dynamic stiffness curve separately for the string of the Present Example shown in FIG. 7.
Figure 8:
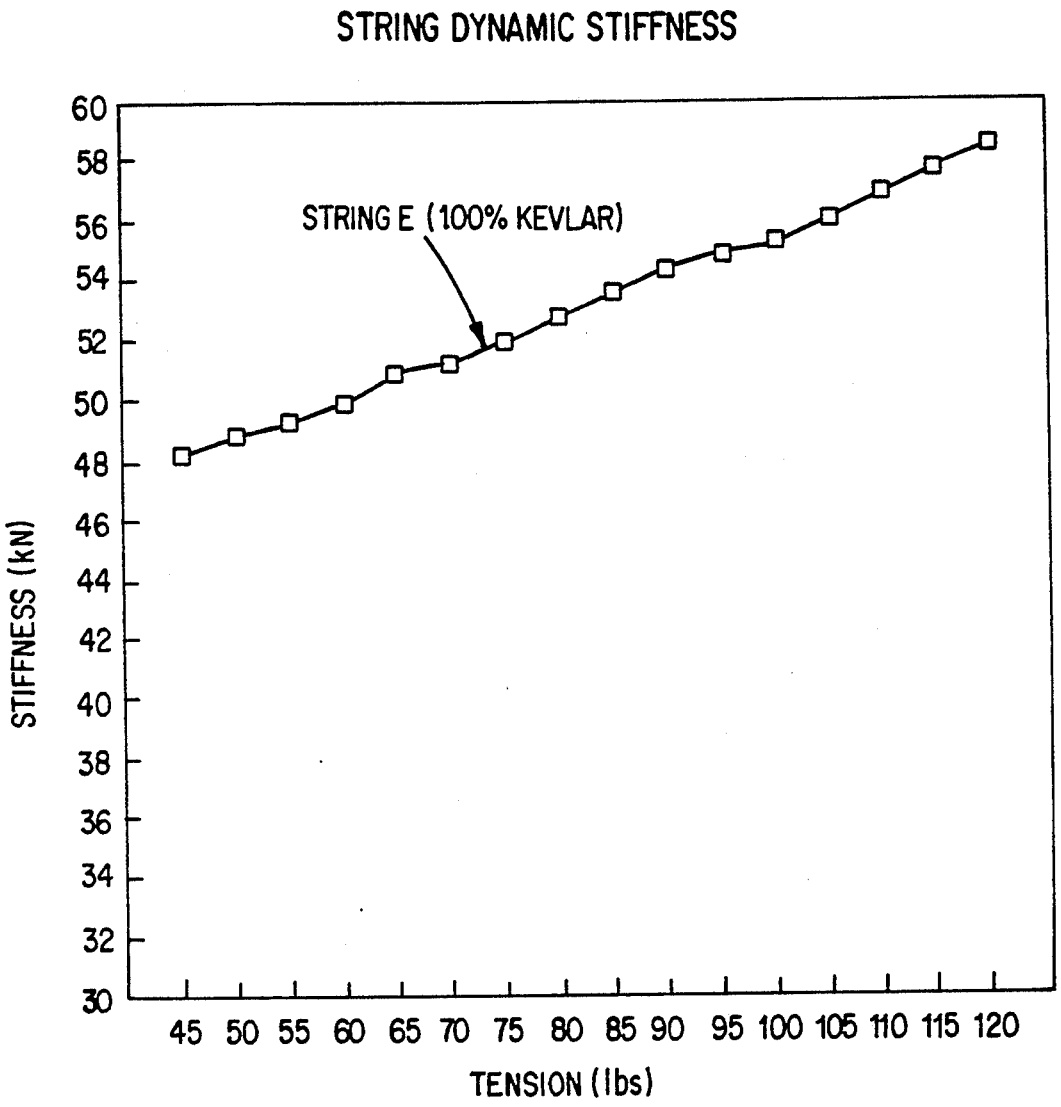
FIG. 8 shows the dynamic stiffness curve for a string made of 100% KEVLAR material.
Figure 9:
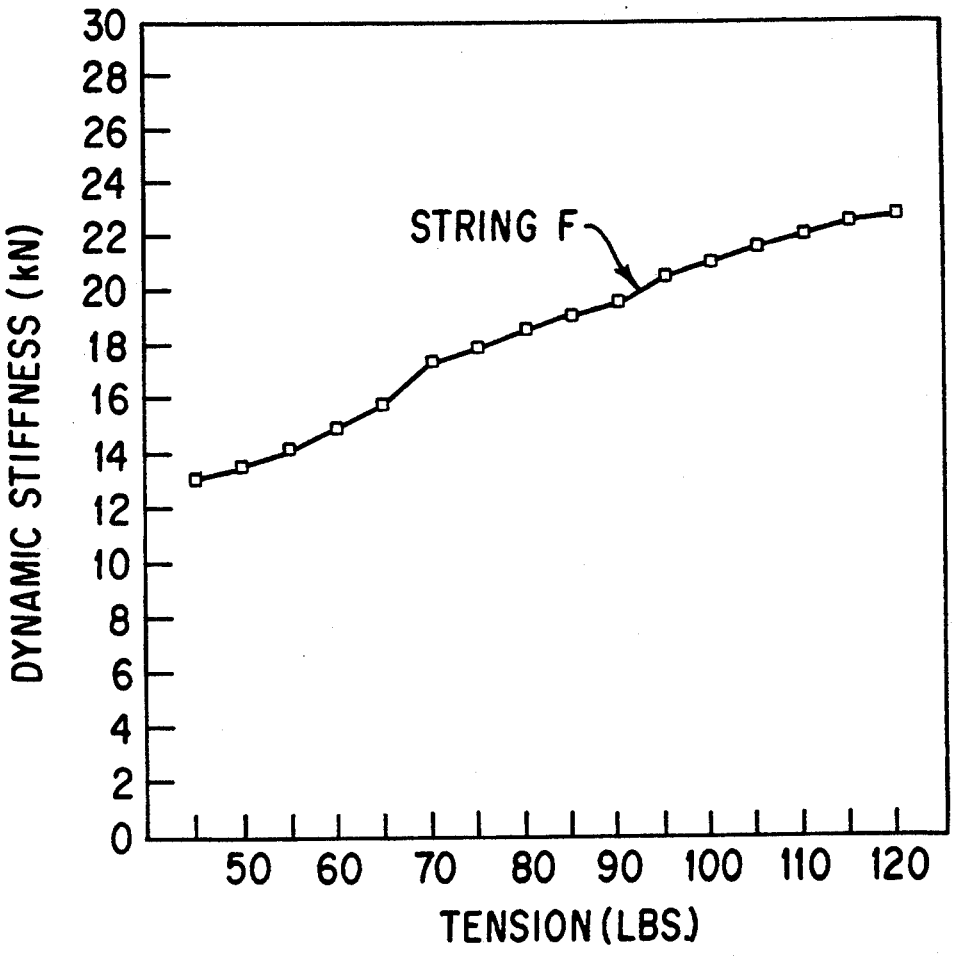
FIG. 9 shows the dynamic stiffness curve for a string made by Wilson and sold under the name Dualtec 137.
Figure 10:
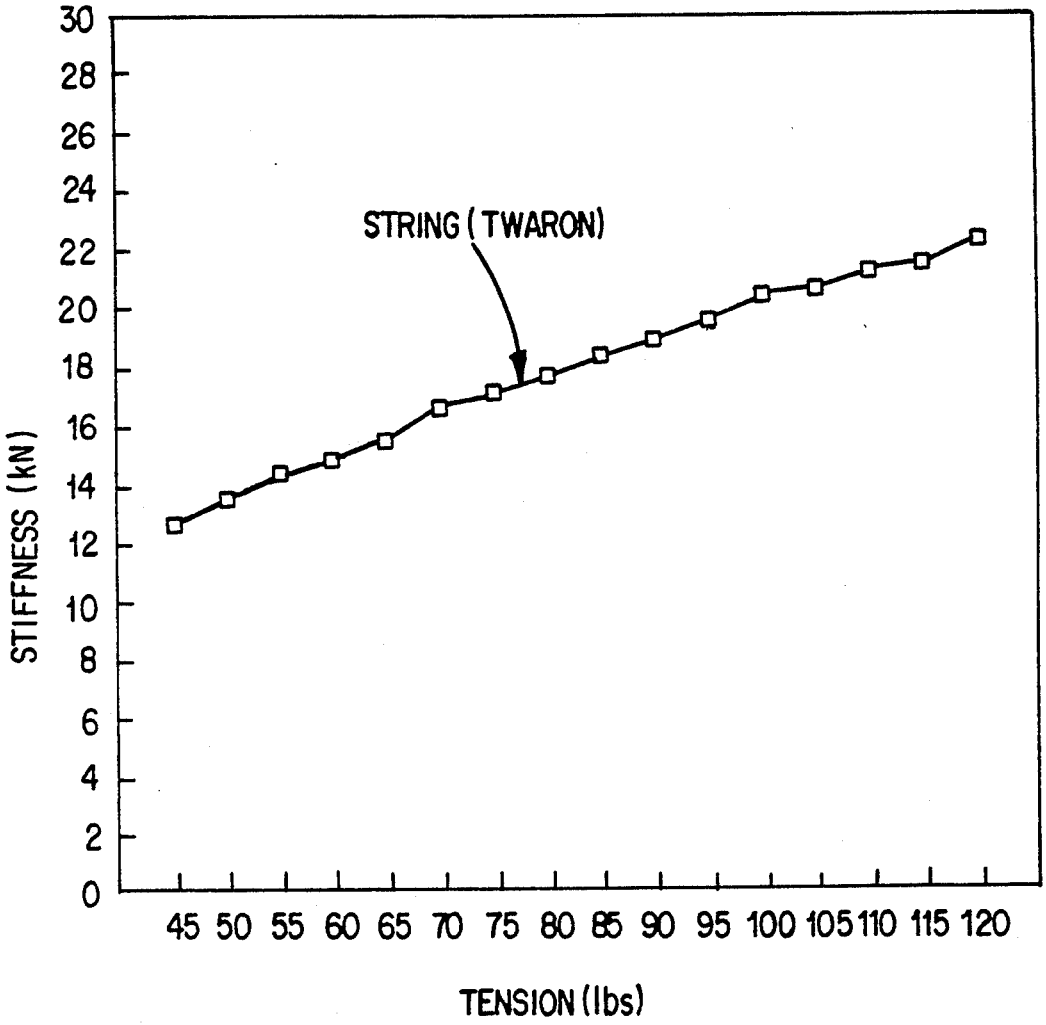
FIG. 10 PRIOR ART
FIG. 10 shows the dynamic stiffness curve for a string made by Head Sports and sold under the name TWARON.

FIG. 7 shows dynamic stiffness of various types of strings, including the embodiment exemplified in the Example of the Preferred Embodiment above; a prior art string (A) known as Prince SYNTHETIC GUT 16 gauge (FIG. 7*a*) which is substantially similar to the above Example, but without the protective NOMEX wraps; a prior art nylon/PEEK composite string (B) known as Prince RESPONSE; a prior art 100% PEEK string (C) known as Prince PREMIERE; a prior art natural animal gut string (D); a prior art 100% KEVLAR string (E); and a prior art nylon/TECHNORA string (F) known as Wilson DUALTEC 137, which has a substantially similar construction as the above Example, the difference being the use of TECHNORA material versus NOMEX material. FIG. 7*a* and Table 2 below show the dynamic stiffness of the string (A) in more detail. FIG. 7*b* and Table 2 show the dynamic stiffness of the present Example in more detail.

TABLE 2

| | Dynamic Stiffness | | | |
|---|---|---|---|---|
| | String (A) | | The Example | |
| Tension (lbs) | Frequency (Hz) | Stiffness (N) | Frequency (Hz) | Stiffness (N) |
| 45 | 312.5 | 12012 | 317.5 | 12399 |
| 50 | 320.0 | 12595 | 322.5 | 12793 |
| 55 | 327.5 | 13193 | 330.0 | 13395 |
| 60 | 335.0 | 13804 | 335.0 | 13804 |
| 65 | 340.0 | 14219 | 342.5 | 14429 |
| 70 | 345.0 | 14640 | 350.0 | 15068 |
| 75 | 350.0 | 15068 | 355.0 | 15501 |
| 80 | 357.5 | 15720 | 360.0 | 15941 |
| 85 | 360.0 | 15941 | 367.5 | 16612 |
| 90 | 370.0 | 16839 | 375.0 | 17297 |
| 95 | 375.0 | 17297 | 382.5 | 17996 |
| 100 | 385.0 | 18232 | 387.5 | 18469 |
| 105 | 395.0 | 19191 | 390.0 | 18708 |
| 110 | 397.5 | 19435 | 395.0 | 19191 |
| 115 | 402.5 | 19927 | 400.0 | 19680 |
| 120 | 405.0 | 20175 | 405.0 | 20175 |
| Stiffness Slope (N/lb) | 112.3 | | 106.8 | |
| 60 lb Value (N) | 13616 | | 13938 | |
| Response Index | 45% | | 41% | |

Dynamic stiffness is a measure of how well a string will play when strung in a racquet and is described in U.S. Pat. No. 4,586,708 to Smith, et al., the disclosure of which is incorporated herein by reference as mentioned above. The dynamic stiffness test is carried out with strings having equal weights of material so that results can be compared with each other. For string materials of equal density, strings of equal gauge are used. Where the density of string materials differ, the gauges are adjusted relative to each other so that strings of differing gauges but equal weights of material are used in the tests.

The test results shown in FIGS. 7 and 7*a* and Table 2 were obtained by vertically supporting the string to be tested (all 16 gauge, 1.33 mm) at one end, then having it hang vertically from that end around and over a system of two pulleys, and then be tensioned by a first weight attached to the free end below the pulleys. A second weight of known mass is attached to the strings between its upper supported end and the pulleys. The string is disturbed from its stationary position by striking the opposite end to which the first weight is attached. This causes the second weight to oscillate up and down as the string vibrates in response to the disturbing force. The number of oscillations are counted which, through a known mathematical equation, give an indication of the dynamic stiffness of the string. Additional weight is then added to the first weight in increments of five lbs, and then the frequency measured with each addition of incremental weight. Utilizing a mathematical least square fit method, a line is fitted through the data points, and is used to extrapolate the values of stiffness slope (N/lb), 60 lb value and a response index, the response index being defined as the percent increase in dynamic stiffness from 50 lbs to 100 lbs. This extrapolated 60 lb value is the point used for comparing the static and dynamic stiffnesses of the respective materials.

The dynamic stiffness tests reveal that there is no significant difference between Prior Art (A) string, and the present Example string with NOMEX wraps, thus demonstrating that the playability of the present Example string is generally equal to the Prior Art String. However, the resistance of the present Example string to abrasion, notching, wear and premature string breakage is substantially increased over the Prior Art (A) string, without sacrifice of playability.

FIGS. 8, 9, 10 and 11 show dynamic stiffness curves for strings made of 100% KEVLAR material, Wilson's Dualtec 137 which contains TECHNORA para-aramid material, Head Sports' TWARON string containing similar para-aramid material, and a string made of 100% NOMEX material, respectively. The vertical scale for the FIG. 8 curve ranges from 30 to 60 whereas the scale is from 0 to 30 for the remaining three curves of FIGS. 9, 10 and 11. As is evident, the KEVLAR string is extremely high in dynamic stiffness and, therefore, very low in resiliency. Therefore, strings made with helical wraps of this type of para-aramid fiber, such as those shown in FIGS. 9 and 10 have insufficient resiliency and playability.

Figure 11:
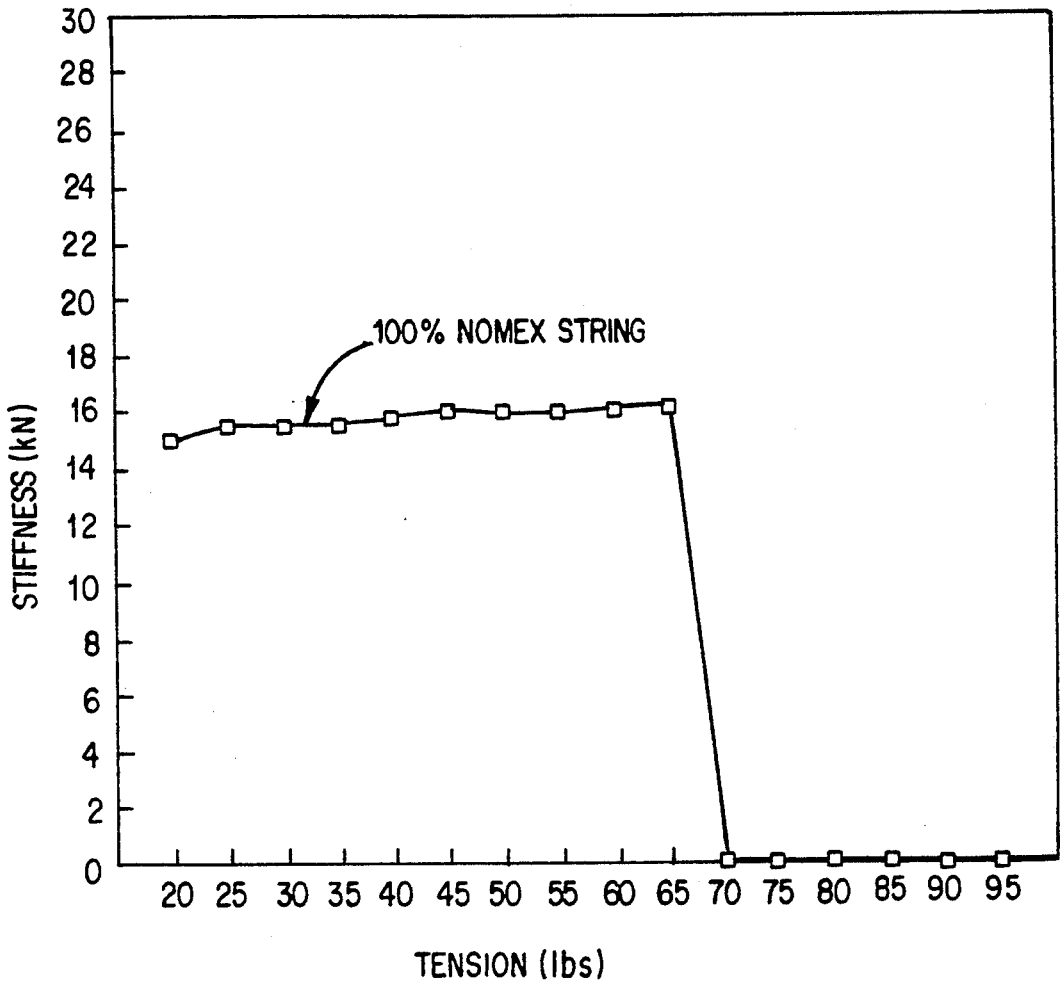
FIG. 11 shows the dynamic stiffness curve for a string made of 100% NOMEX material.

FIG. 11 illustrates that a string of 100% NOMEX material has a dynamic stiffness slope that is practically horizontal. Thus, this fiber which is a meta-linked aramid material has very low dynamic stiffness and thus very high resiliency. This is one of the important differences in the characteristics of NOMEX material compared to KEVLAR material. As a result, NOMEX material has been found to provide the superior combination of abrasion resistance, resistance to notching and playability in strings made in accordance with this invention.

The following Static Creep test and Dynamic Tension Loss test compares between a Prior Art nylon string (Prince SYNTHETIC GUT 16 gauge, hereafter "Prior Art") and the string of the present Example of 16 gauge, which is substantially similar to the Prince SYNTHETIC GUT 16, but with the addition of the NOMEX wraps. These tests are a measure of the overall loss of string tension after the string is strung into a racquet. When the string loses tension, it basically means that the string has increased in length due to the tension and the impact force. If the string elongates beyond its elastic limit, that is, if in response to the force of ball impact the string does not return to its original length, i.e., it becomes longer, the string will exhibit a loss of tension causing a trampoline or sling-shot like characteristic in further play. This, in turn, creates excessive power and a loss of control and feel of shots. Therefore, it is critical to restrict loss of overall string tension to a minimum.

3. Static Creep Test

Figure 12:
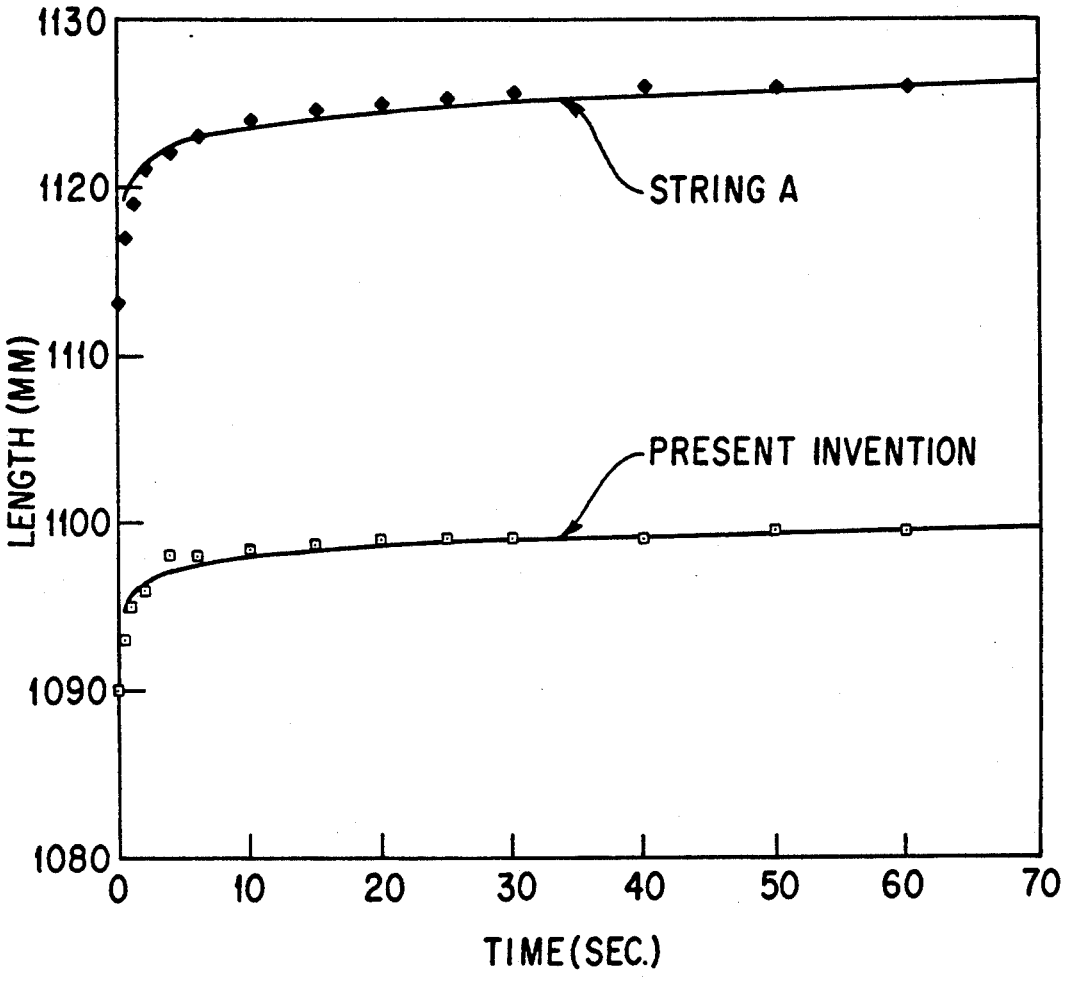
FIG. 12 shows a stretch comparison between the string of the Present Example and a Prior Art string.

This test measures the change in length as a function of time after hanging 60 lbs of weight on a 2 meter long string, which is indicative of the string's resistance to loss of tension, the greater the creep, the lesser being the capability of the string to hold tension. Tape is then applied to the string to mark off a 1 meter distance (or gauge length) on it. At time 0, when the weight was applied, the present Example was measured to be 1090 mm and the Prior Art was measured to be 1113 mm. Measurements were recorded after increments of time and plotted until no further stretching of the string was observed. FIG. 12 depicts the stretch comparison between time 0 and 60 elapsed minutes. Therefore, after one hour, the present Example stretched from 1090 mm to 1099.5 mm or a stretch of 9.5 mm, while the Prior Art stretched from 1113 mm to 1126 mm or a stretch of 13 mm. Thus, the present Example showed 25% less creep and at a slower rate as compared to the Prior Art, due to the addition of the NOMEX wraps.

4. Dynamic Tension Loss Test

This test was conducted to measure the string-bed stiffness before and after the durability test set forth below. Six identical racquets were strung, three with the string of the present Example and three with the Prior Art string. Their initial string-bed stiffnesses were measured on an RA test machine, which is a standard test device generally known in the art of tennis. Thereafter, they were placed under the durability test for 150 hits each, after which the RA stiffness were again measured. The results are shown in Table 3 below.

TABLE 3

| | RA String-Bed Stiffness | | | | | |
|---|---|---|---|---|---|---|
| | PRIOR ART | | | PRESENT EXAMPLE | | |
| | 1 | 2 | 3 | 4 | 5 | 6 |
| Initial RA | 64.5 | 65 | 66 | 65 | 66 | 65.5 |
| Final RA | 61 | 61 | 62 | 64.5 | 65 | 65 |
| ΔRA | −3.5 | −4.0 | −4.0 | −0.5 | −1.0 | −0.5 |
| Loss % ΔRA | −5.4% | −6.2% | −6.1% | −0.8% | −1.5% | −0.8% |

The above results clearly show that after dynamic impact (pounding with 150 balls shot at 80 MPH), the present Example loses on average only 1.0% of its original string-bed stiffness while the Prior Art experiences a 5.9% loss of string-bed stiffness. Thus, the string of the present invention is much more capable of maintaining its original tension.

5. Durability Test

To measure durability, a top-spin player hitting at 80 MPH is simulated. Tennis balls are fired at 80 MPH at a rate of one every 4 seconds at the string bed of a racquet. The cross-strings of the racquet head are tilted at 51° relative to the path of the incoming ball to simulate the top-spin action. The racquet head is rotated 102° after every hit, about the racquet's longitudinal axis, and the racquet head is also moved 35 mm in the longitudinal direction, toward and away from the handle, at slow rate, to spread the wear area across several main- and cross-strings. This test simulates the notching of main-strings, from rubbing across the cross-strings, that occurs during actual play. The balls are fired until a main-string breaks. The number of balls fired to break the string is recorded.

Two vendors A and B, experienced in the manufacture of synthetic tennis racquet strings, at the request of the inventors supplied 16 gauge samples of conventional prior art synthetic string and of the preferred embodiment of this invention illustrated in FIGS. 1 and 1*a* of the drawings. A set of ten duplicate racquets was strung with each of the sample strings at 60 lbs. Each racquet was tested for durability in accordance with the durability test described above. The average durability results and percentage increases observed for each set of ten racquets for the prior art string compared to the preferred embodiment, per vendor, as well as the overall averages of both vendors, are shown in Table 4 below.

TABLE 4

| Vendor | Prior Art | Durability Preferred Embodiment | % Increase Over Prior Art |
|---|---|---|---|
| B | 296 | 759* | 156% |
| A | 386 | 558 | 45% |
| Average | 341 | 659 | 93.2% |

*This result was the average of five duplicate test racquets. Also, vendor B supplied a previous sample without prior experience of incorporating Nomex fibers in a synthetic string, which previous sample gave 342 hits to break, or a 15.5% increase over the prior art string.

In play, it has been observed that the NOMEX wraps act as a highly effective abrasion resistant protector for the core, effectively stopping the notching of the main string which substantially enhances durability by as much as 50% or more. In tests with substantially identical strings without the NOMEX wraps and substantially identical conditions, it has been found that the notching will progress into and cut the core resulting in string breakage. On the other hand, with the NOMEX wrapped string, when the notching cuts through the outer sheath and reaches the NOMEX wraps, further string movement is noticeably reduced and the string mesh tends to become locked in place.

A string made in accordance with the principles of this invention provides a combination of dynamic stiffness and durability properties which is highly advantageous. Specifically, a 16 gauge, 1.33 mm diameter string, as shown in Tables 2 and 4 discussed above, has an extrapolated dynamic stiffness of up to a maximum of nearly 14,000 at 60 pounds and a durability of at least 558 at 60 pounds. To the inventors' knowledge, this combination has not been attainable with racquet strings of the prior art.

The foregoing is an illustration of the principles of the present invention. As previously indicated, the present invention is not to be limited solely to the exact configuration, construction and the example set forth herein. All expedient modifications readily known or obvious to one skilled in the art from the teachings of the present invention, which may be made within the scope and essence of the present invention, are included as further embodiments of the invention. For example, while the present invention has been described for use in particular with synthetic materials, it is within the purview of the present invention to use the teachings disclosed herein to incorporate protective wrap(s) to reinforce a natural gut or natural silk center core.

The invention has been disclosed in terms of racquets for various sports. The new string of this invention has application in other sporting activities such as fishing lines, kite strings, parachutes, bow strings, water skiing ropes, sailboat lines, and the like.

We claim:

1. A string for sports applications comprising:

a core composed of at least one material having a first melting point and a first static stiffness;

a protective layer of an abrasion resistant material covering at least a portion of the core to protect the core from wear, the abrasion resistant material having a second melting point and a second static stiffness; and an outer sheath means for sealing the surfaces of the core and the protective layer, wherein the first melting point is lower than the second melting point and the first static stiffness is higher than the second static stiffness.

2. A string according to claim 1, wherein the protective layer covers the entire surface of the core.

3. A string according to claim 1, wherein the protective layer is at least one ribbon-like wrap, helically wrapped around the core.

4. A string according to claim 3, wherein the protective layer is two 180° spaced apart ribbon-like wraps, helically wrapped around the core in the same direction.

5. A string according to claim 4, wherein the helically wrapped ribbon-like wraps cover at least 50% the surface of the core.

6. A string according to claim 5, wherein additional multifilament nylon is included between the ribbon-like wraps of abrasion resistant material to cover the remaining core surface.

7. A string according to claim 1, wherein the string has a diameter of 1.33 mm, an extrapolated dynamic stiffness up to about a maximum of 14,000 at 60 pounds and a durability of at least about 558 at 60 pounds.

8. A string according to claim 1, 2, 3, 4, 5, 6 or 7, wherein the abrasion resistant material is poly(m-phenylene isophthalamide).

9. A string according to claim 1, wherein at least one material of the core comprises nylon.

10. A string according to claim 1, wherein at least one material of the core comprises nylon copolymer.

11. A string according to claim 1, wherein at least one material of the core comprises polyester.

12. A string according to claim 1, wherein at least one material of the core comprises polybutylene terephthalate.

13. A string according to claim 1, wherein at least one material of the core comprises polypropylene-polyethylene-diene terpolymer.

14. A string according to claim 1, wherein at least one material of the core comprises polyphenylene sulfide.

15. A string according to claim 1, wherein at least one material of the core comprises polyetheretherketone.

16. A string for sports applications comprising:

a core composed of at least one material having a first melting point and a first dynamic stiffness;

a protective layer of an abrasion resistant material covering at least a portion of the core to protect the core from wear, the abrasion resistant material having a second melting point and a second dynamic stiffness; and an outer sheath means for sealing the surfaces of the core and the protective layer, wherein the first melting point is lower than the second melting point, and the second dynamic stiffness is higher than the first dynamic stiffness by up to 25%.

17. A string according to claim 16, wherein the protective layer covers the entire surface of the core.

18. A string according to claim 16, wherein the protective layer is at least one ribbon-like wrap, helically wrapped around the core.

19. A string according to claim 18, wherein the protective layer is two 180° spaced apart ribbon-like wraps, helically wrapped around the core in the same direction.

20. A string according to claim 18, wherein the helically wrapped ribbon-like wraps cover at least 50% the surface of the core.

21. A string according to claim 20, wherein additional multifilament nylon is included between the ribbon-like wraps of abrasion resistant material to cover the remaining core surface.

22. A string according to claim 16, 17, 18, 19 20 or 21, wherein the abrasion resistant material is poly(m-phenylene isophthalamide).

23. A string according to claim 16, wherein the at least one material of the core is selected from the group consisting essentially of nylon, nylon copolymer, polyester, polybutylene terephthalate, polypropylene-polyethylene-diene terpolymer, polyphenylene sulfide and polyetheretherketone.

24. A string for sports applications comprising:

a core composed of at least one material having a first melting point, a first dynamic stiffness and a first static stiffness;

a protective layer of an abrasion resistant material covering at least a portion of the core to protect the core from wear, the abrasion resistant material having a second melting point, a second dynamic stiffness and a second static stiffness; and an outer sheath means for sealing the surfaces of the core and the protective layer, wherein the first melting point is lower than the second melting point, the first static stiffness is higher than the second static stiffness, and the second dynamic stiffness is higher than the first dynamic stiffness by up to 25%.

25. A string according to claim 23, wherein the protective layer covers the entire surface of the core.

26. A string according to claim 23, wherein the protective layer is at least one ribbon-like wrap, helically wrapped around the core.

27. A string according to claim 26, wherein the protective layer is two 180° spaced apart ribbon-like wraps, helically wrapped around the core in the same direction.

28. A string according to claim 27, wherein the helically wrapped ribbon-like wraps cover at least 50% the surface of the core.

29. A string according to claim 28, wherein additional multifilament nylon is included between the ribbon-like wraps of abrasion resistant material to cover the remaining core surface.

30. A string according to claim 24, 25, 26, 27 28 or 29, wherein said second material is poly(m-phenylene isophthalamide).

31. A string according to claim 24, wherein the at least one material of the core is selected from the group consisting essentially of nylon, nylon copolymer, polyester, polybutylene terephthalate, polypropylene-polyethylene-diene terpolymer, polyphenylene sulfide and polyetheretherketone.

32. A string for sports applications comprising:

a core composed of at least one material having a first melting point, a first dynamic stiffness and a first static stiffness;

an abrasive resistant protective layer consisting essentially of poly(m-phenylene isophthalamide) covering at least a portion of the core to protect the core from wear, the abrasion resistant protective layer having a second melting point, a second dynamic stiffness and a second static stiffness; and an outer sheath means for sealing the surfaces of the core and the protective layer, wherein the first melting point is lower than or equal to the second melting point, the first dynamic stiffness is lower than or equal to the second dynamic stiffness, and the first static stiffness is higher than or equal to the second melting point.

33. A string according to claim 32, wherein the protective layer covers the entire surface of the core.

34. A string according to claim 32, wherein the protective layer is at least one ribbon-like wrap, helically wrapped around the core.

35. A string according to claim 34, wherein the protective layer is two 180° spaced apart ribbon-like wraps, helically wrapped around said core in the same direction.

36. A string according to claim 35, wherein the helically wrapped ribbon-like wraps covers at least 50% the surface of core.

37. A string according to claim 36, wherein additional multifilament nylon is included between the ribbon-like wraps of abrasion resistant material to cover the remaining the core surface.

38. A string according to claim 32, 33, 34, 35 36 or 37, wherein the at least one material of the core is selected from the group consisting essentially of nylon, nylon copolymer, polyester, polybutylene terephthalate, polypropylene-polyethylene-diene terpolymer, polyphenylene sulfide and polyetheretherketone.

39. A string for sports applications comprising:

a core consisting of a first material;

a protective layer consisting of two 180° spaced apart ribbon-like wraps consisting essentially of poly(m-phenylene isophthalamide), helically wrapped around the core in the same direction and covering at least 50% of the surface of the core; and an outer sheath means for sealing the surfaces of the core and the protective layer, wherein the first material is other than poly(m-phenylene isophthalamide) and wherein when the string is incorporated in a string bed, the RA string-bed stiffness thereof is reduced on average only up to about 1.5% measured by the dynamic tension loss test.

40. A string according to claim 39, wherein the first material is nylon.

41. A string according to claim 39, wherein the first material is an extruded, prestretched, thermoset nylon.

42. A string according to claim 39, wherein the material of the core is selected from the group consisting essentially of nylon, nylon copolymer, polyester, polybutylene terephthalate, polypropylene-polyethylene-diene terpolymer, polyphenylene sulfide and polyetheretherketone.

43. A string for sports application comprising a string having a diameter of 1.33 mm, an extrapolated dynamic stiffness of up to about a maximum of 14,000 at 60 pounds and a durability of at least about 558 at 60 pounds.

44. A sports racquet strung with a string comprising:

a core composed of at least one material having a first melting point and a first static stiffness;

a protective layer of an abrasion resistant material covering at least a portion of the core to protect the core from wear, the abrasion resistant material having a second melting point and a second static stiffness; and an outer layer means for sealing the surfaces of the core and the protective layer, wherein the first melting point is lower than the second melting point and the first static stiffness is higher than the second static stiffness.

45. A sports racquet according to claim 44, wherein the core has a first dynamic stiffness and the protective layer has a second dynamic stiffness, the second dynamic stiffness being higher than the first dynamic stiffness by up to 25%.

46. A sports racquet according to claim 44, wherein the protective layer covers the entire surface of the core.

47. A sports racquet according to claim 44, wherein the protective layer is at least one ribbon-like wrap, helically wrapped around the core.

48. A sports racquet according to claim 47, wherein the protective layer is two 180° spaced apart ribbon-like wraps, helically wrapped around the core in the same direction.

49. A sports racquet according to claim 48, wherein the helically wrapped ribbon-like wraps cover at least 50% the surface of said core.

50. A sports racquet according to claim 49, wherein additional multifilament nylon is included between the ribbon-like wraps of abrasion resistant material to cover the remaining core surface.

51. A sports racquet according to claim 44, 45, 46, 47, 48, 49 or 50, wherein the abrasion resistant material is poly(m-phenylene isophthalamide).

52. A sports racquet according to claim 44, wherein the at least one material of the core is selected from the group consisting essentially of nylon, nylon copolymer, polyester, polybutylene terephthalate, polypropylene-polyethylene-diene terpolymer, polyphenylene sulfide and polyetheretherketone.

53. A sports racquet according to claim 44, wherein the racquet is a badminton racquet, a racquetball racquet, squash racquet, or a tennis racquet.

* * * * *